US006886604B2

(12) United States Patent
Berktold

(10) Patent No.: US 6,886,604 B2
(45) Date of Patent: May 3, 2005

(54) APPARATUS AT A WEAVING MACHINE FOR THE PROTECTION OF PERSONS

(75) Inventor: Klaus Berktold, Rueti (CH)

(73) Assignee: Sulzer Textil AG, Rüti (CH)

( * ) Notice: Subject to any disclaimer, the term of this patent is extended or adjusted under 35 U.S.C. 154(b) by 214 days.

(21) Appl. No.: 10/295,140

(22) Filed: Nov. 15, 2002

(65) Prior Publication Data

US 2003/0102046 A1 Jun. 5, 2003

(30) Foreign Application Priority Data

Dec. 4, 2001 (EP) ..... 01811172

(51) Int. Cl.[7] ..... D03D 51/00
(52) U.S. Cl. ..... 139/336; 250/221
(58) Field of Search ..... 139/50, 54, 430, 139/368, 110; 700/140; 250/221

(56) References Cited

U.S. PATENT DOCUMENTS 5,218,196 A * 6/1993 Dogul et al. ..... 250/221
6,166,371 A * 12/2000 Milbrath et al. ..... 250/221
6,236,038 B1 * 5/2001 Givet ..... 250/221

FOREIGN PATENT DOCUMENTS

CH 651864 A5 10/1985
FR 2 511 713 2/1983
JP 01014346 1/1989
JP 06321398 11/1994
JP 08081858 3/1996

* cited by examiner

*Primary Examiner*—Gary L. Welch
*Assistant Examiner*—Brian Kauffman
(74) *Attorney, Agent, or Firm*—Townsend and Townsend and Crew LLP

(57) ABSTRACT

An apparatus at a weaving machine serves for the protection of persons in danger regions which extend about a beat-up edge along a weaving width and beyond the latter. In this apparatus, monitoring means which emit and register light beams are arranged about the danger regions. Signals which arise as a result of an encroachment into the danger regions and through which an operating stop of the weaving machine can be triggered can be produced in the monitoring means by means of the light beams. First monitoring means are associated with a more comprehensive region and second monitoring means are associated with a central region, the actual danger region. During a normal operation of the weaving machine the first monitoring means are in an active state which ensures the protection. An activation of the second monitoring means is provided for use during activities which are occasionally to be carried out at the weaving machine within the more comprehensive region.

9 Claims, 1 Drawing Sheet

APPARATUS AT A WEAVING MACHINE FOR THE PROTECTION OF PERSONS

BACKGROUND OF THE INVENTION

The invention relates to an apparatus at a weaving machine for the protection of persons. It also refers to a corresponding method for accident prevention.

Danger regions exist in a weaving machine between components of the machine which are moved back and forth and stationary components in which a person who is working at the machine can sustain contusions of the hands. Danger regions of this kind are present in particular between the sley and cloth temples, and with selvedge tuckers and leno apparatuses; further danger regions are present between the sley and the actual weaving machine frame. Light barriers are used as monitoring means for the purpose of accident prevention. In order that the weaving machine comes to a halt in time during a normal operation, the monitoring means must be arranged at a larger distance from the danger region. If the distance is too small, then the reaction time of the weaving machine prior to it stopping is not sufficient. A light curtain arrangement, that is, a monitoring means which emits and registers light beams and which covers the danger region at a sufficiently large distance with a large number of light beams, has been proposed as a monitoring means. In the event of activities which are occasionally to be carried out at the running weaving machine, the proposed light curtain arrangement hinders or renders impossible the access to the site of intervention. An activity of this kind is for example an intervention for the correction of a break in a warp thread, in which a warp thread segment which is to be newly inserted must be held taut.

SUMMARY OF THE INVENTION

An object of the invention is to create, for the protection of persons, for danger regions in weaving machines which extend around a beat-up edge, an apparatus which enables the operating personnel to exercise specific intervention activities without danger—for example the correction of a break in a warp thread—at the running weaving machine.

The apparatus at a weaving machine serves for the protection of persons in danger regions which extend about a beat-up edge along a weaving width and beyond the latter. In this apparatus, monitoring means which emit and register light beams are arranged about the danger regions. Signals which arise as a result of an encroachment into the danger regions and through which an operating stop of the weaving machine can be triggered can be produced in the monitoring means by means of the light beams. First monitoring means are associated with a more comprehensive region and second monitoring means are associated with a central region, the actual danger region. During a normal operation of the weaving machine the first monitoring means are in an active state which ensures the protection. An activation of the second monitoring means is provided for use during activities which are occasionally to be carried out at the weaving machine within the more comprehensive region.

One embodiment of the present invention provides a method for an accident protection at a weaving machine wherein first and second monitoring means may be controlled in such a manner that during a standstill of the machine, in a starting-up operation or during a creep speed operation, only the second monitoring means are brought into the active state. Additionally, after start-up of the weaving machine, i.e. after a start of the normal operation, the first monitoring means are activated, with it being possible for the second monitoring means to be left in the active state or to be deactivated.

Another embodiment of the present invention provides a method wherein after the start of the normal operation, all monitoring means are simultaneously held in their activated states during a short time interval, with this time interval in particular lasting at least one second.

Another embodiment of the present invention provides a method wherein the control systems of the monitoring means are designed in such a manner that signals which are produced through fiber fly are detected as a result of specific signal patterns. Additionally, in the event that only signals of this kind arise, the triggering of the operation stop is suppressed.

The monitoring means are controlled in such a manner that during a standstill of the weaving machine, during a putting into operation or during a creep speed operation only the second monitoring means are in the active state. After a starting of the normal operation, the first monitoring means are activated, whereas the second monitoring means are preferably deactivated with a delay. The second monitoring means can however also remain active.

After the starting of the normal operation all monitoring means are held simultaneously in their active states at least during a brief time interval. This time interval lasts for example one second.

In the following the invention will be explained with reference to the drawings.

DESCRIPTION OF THE PREFERRED EMBODIMENTS

Figure 1:
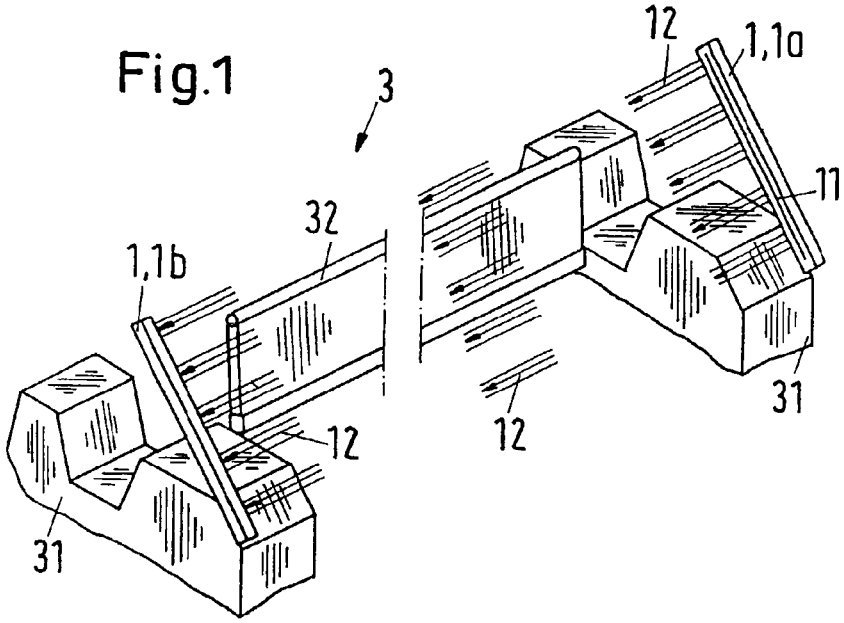
FIG. 1 illustrates a part of a weaving machine with a light curtain or light grid arrangement.

A weaving machine 3, which is partly illustrated in FIG. 1, has a light curtain or light grid arrangement 1 which comprises a component 1*a* which emits light beams 12 and a component 1*b* which registers the emitted light beams 12. The light curtain arrangement 1 is secured to a machine chassis 31. It forms monitoring means which, for the purpose of screening off danger regions, are arranged at a relatively large distance within a more comprehensive environment of the danger region. The danger regions are located ahead of a sley 32 and in access zones to the left and right of the sley 32. A large number of light beams 12 are emitted by a row of light sources 11 of the component 1*a*. The emission of the light beams 12 takes place in an area, in particular in a plane. The plane can for example also be curved in an arcuate or curve-shaped manner and/or have gaps which are free of light beams 12.

Figure 2:
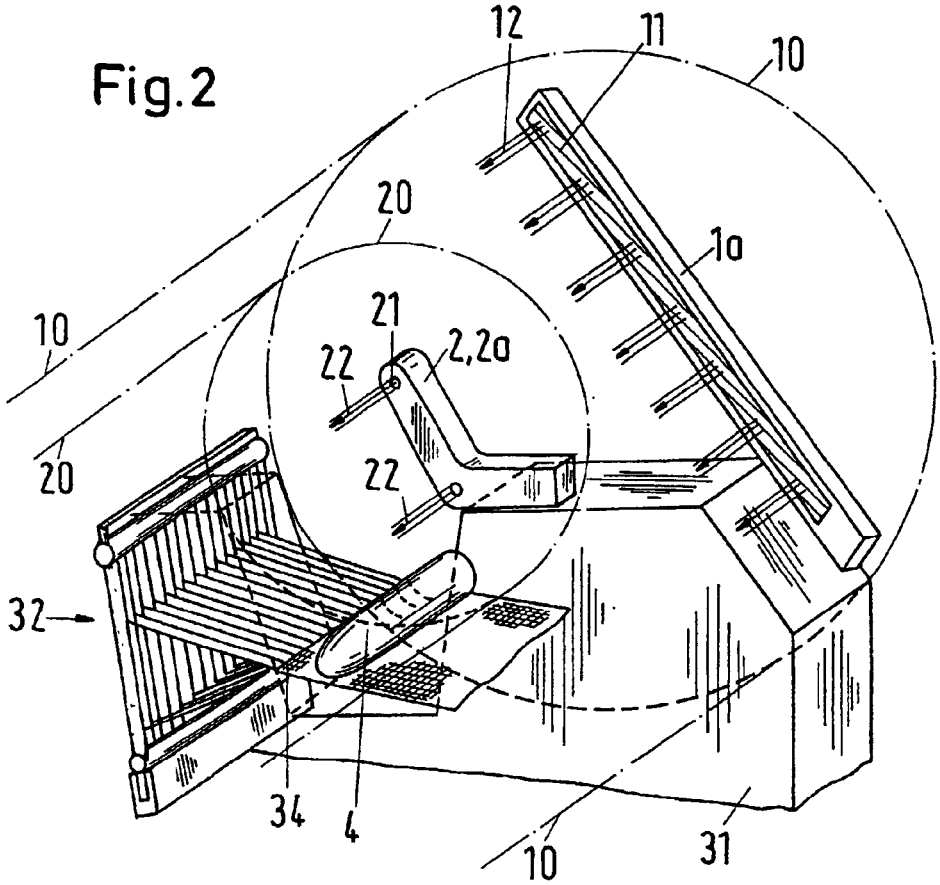
FIG. 2 illustrates a part of an apparatus in accordance with the invention.

The light curtain or light grid arrangement 1 forms first monitoring means of the apparatus in accordance with the invention, which is partly illustrated in FIG. 2. The named more comprehensive environment is illustrated there symbolically by a cylinder 10, which is drawn in chain-dotted lines.

FIG. 2 shows one-half of the apparatus in accordance with the invention, namely the component 1*a* of the light curtain arrangement 1 which emits light beams 12 and a component 2*a* of a light curtain arrangement 2 which emits light beams 22. The additional arrangement 2, through which second monitoring means are formed, has light sources 21, with two or a larger number of light sources 21—preferably two to six—being provided. The light barrier arrangement 2 comprises, just as the light curtain arrangement 1, a second, non-illustrated component, by means of which the light beams 22 which are emitted by the component 2*a* can be registered. The second monitoring means 2 are arranged in a more restricted environment 20 of the danger regions. The danger regions extend along a beat-up edge 34 and beyond the latter; danger regions are located in particular between the sley 32 and cloth temples 4. The paths of the emitted light beams 12, 22 preferably extend parallel to the beat-up edge 34 over the weaving width as well as laterally to the left and right over regions extending beyond the weaving width. These lateral regions are advantageously made relatively large, so that the operating personnel is not able to carry out interventions into the danger regions laterally around the light beams 12.

Signals can be produced in the monitoring means 1 and 2 by means of the light beams 12 and 22 respectively. These result in the event of an encroachment into the danger regions. An operation stop of the weaving machine can be triggered by the signals.

The first monitoring means 1 are associated with the more comprehensive region 10. The second monitoring means 2 are associated with the central region 20, the actual danger region. During a normal operation of the weaving machine 3 the first monitoring means 1 are in an active state which ensures the protection. An activation of the second monitoring means 2 is—as already mentioned—provided for interventions which are to be carried out occasionally during activities at the weaving machine, for example for interventions into the more comprehensive region 10 during the starting phase.

The light curtain of the arrangement 2, which is active during the weaving operation, causes a significant increase in the accident protection. However, for the manufacture of cloths in which fibers are liberated in the form of a fiber fly, disturbance signals often come about which lead to unnecessary stoppage of the weaving machine. This problem can be eliminated by designing the control systems of the monitoring means 1, 2 in such a manner that signals which are produced through fiber fly are detected as a result of specific signal patterns. If only signals of this kind arise, the triggering of the stopping of the operation is suppressed. Specific signal patterns result for example by light reflection intensities which are different in the case of floating fibers than in the case of dense bodies. Further examples are a particular characteristic of movement of the fibers or a characteristic time interval between two time points at which a first and a second light beam 12, 22 are respectively interrupted by a fiber.

The light curtain (or light grid) which is produced by the light beams 12 can be interrupted in at least one interval of its longitudinal extent in the direction of the beat-up edge 34. An embodiment of this kind is recommendable for example in the use of known separating selvedge laying apparatuses and/or leno apparatuses within the weaving width, such as are used in the weaving of separate fabric webs.

What is claimed is:

1. An apparatus at a weaving machine for the protection of persons in danger regions which extend about a beat-up edge along a weaving width and beyond the latter, monitoring means which emit and register light beams being arranged in said apparatus about the danger regions and with it being possible to produce, by means of the light beams in the monitoring means, signals which arise as a result of encroachment into the danger regions and through which an operating stop of the weaving machine can be triggered, wherein first monitoring means are associated with a more comprehensive region and second monitoring means are associated with a central region, the actual danger region, with the first monitoring means being brought during a normal operation of the weaving machine into an active state which ensures the protection and with an activation of the second monitoring means being provided for use during activities which are occasionally to be carried out at the weaving machine within the more comprehensive region, and wherein the paths of the emitted light beams are routed parallel to the beat-up edge and over the entire danger region which is formed by the sley.

2. An apparatus in accordance with claim 1, wherein in each case, in the active state, the first monitoring means forms a light curtain arrangement with a large number of light beams and the second monitoring means forms a light curtain arrangement with at least two light beams.

3. An apparatus in accordance with claim 2, wherein the light curtain arrangement has a light curtain which can be produced by means of the light beams and which is interrupted in at least one interval of its longitudinal extent in the direction of the beat-up edge.

4. An apparatus in accordance with claim 2, wherein a plurality of light beams are employed in the light beam arrangement; and wherein the emission of the light beams in the light curtain arrangement takes place in an area.

5. An apparatus in accordance with claim 4 wherein the plurality of light beams are in a range of one to six.

6. An apparatus in accordance with claim 4 wherein the area is a plane.

7. A method for an accident protection at a weaving machine comprising an apparatus that includes monitoring means which emit and register light beams being arranged in said apparatus about the danger regions and with it being possible to produce, by means of the light beams in the monitoring means, signals which arise as a result of encroachment into the danger regions and through which an operating stop of the weaving machine can be triggered, wherein first monitoring means are associated with a more comprehensive region and second monitoring means are associated with a central region, the actual danger region, with the first monitoring means being brought during a normal operation of the weaving machine into an active state which ensures the protection and with an activation of the second monitoring means being provided for use during activities which are occasionally to be carried out at the weaving machine within the more comprehensive region, and wherein the paths of the emitted light beams are routed parallel to the beat-up edge and over the entire danger region which is formed by the sley, wherein the monitoring may be controlled in such a manner that during a stand-still of the machine, in a starting-up operation or during a creep speed operation, only the second monitoring means are brought into the active state, and wherein after starting up of the weaving machine, the first monitoring means are activated, with it being possible for the second monitoring means to be left in the active state or to be deactivated.

8. A method in accordance with claim 7 wherein, after the start of the normal operation, all monitoring means are simultaneously held in their activated states during a short time interval that lasts at least one second.

9. A method in accordance with claim 7 wherein the control systems of the monitoring means are designed in such a manner that signals that are produced through fiber fly are detected as a result of specific signal patterns, and wherein, in the event that only signals of this kind arise, the triggering of the operation stop is suppressed.

* * * * *